US005845576A

United States Patent [19]

Junghans

[11] Patent Number: 5,845,576

[45] Date of Patent: Dec. 8, 1998

[54] METHOD OF CONTROLLING A VIBRATOR ROLLER IN A PRINTING PRESS

[75] Inventor: Rudi Junghans, Wilhelmsfeld, Germany

[73] Assignee: Heidelberger Druckmaschinen Aktiengesellschaft, Heidelberg, Germany

[21] Appl. No.: 831,980

[22] Filed: Apr. 2, 1997

[30] Foreign Application Priority Data

Apr. 3, 1996 [DE] Germany ..... 196 13 360.2

[51] Int. Cl.[6] ..... B41F 31/14; B41F 31/32

[52] U.S. Cl. ..... 101/484; 101/352.09; 101/DIG. 32

[58] Field of Search ..... 101/DIG. 32, 350.3, 101/350.4, 351.3, 352.04, 352.06, 352.09, 483, 484, 485, 492, 148

[56] References Cited

U.S. PATENT DOCUMENTS 3,170,397 2/1965 Dutro et al. .

4,524,692 6/1985 Rodvelt ..... 101/350

5,493,970 2/1996 Stoffler et al. .

FOREIGN PATENT DOCUMENTS 0645242 3/1995 European Pat. Off. .

3443765 7/1985 Germany .

3436047 4/1986 Germany .

3935215 5/1990 Germany .

4411109 9/1995 Germany .

2193926 2/1988 United Kingdom .

*Primary Examiner*—J. Reed Fisher

*Attorney, Agent, or Firm*—Nils H. Ljungman and Associates

[57] ABSTRACT

A method of controlling a vibrator roller in a printing press during printing press stops and printing starts is disclosed. The cycle of the vibrator roller is controlled as a function of the point of time at which the vibrator roller contacts the ink fountain roller, in order to achieve a uniform inking after a printing press stop.

13 Claims, 1 Drawing Sheet

METHOD OF CONTROLLING A VIBRATOR ROLLER IN A PRINTING PRESS

BACKGROUND OF THE INVENTION

1. Field of the Invention

The invention relates to a method of controlling a vibrator roller in a printing press during printing press operation stops and impression throw-on.

2. Background Information

In printing presses, the supply of printing ink is generally provided by an inking unit. Typical inking units have an ink fountain or ink duct with associated ink metering devices, such as ink metering elements or possibly a doctor blade; an ink fountain roller; a vibrator roller or intermittent ductor roller; and one or more ink distribution rollers. The ink metering devices control the thickness of the ink layer on the ink fountain roller. The vibrator roller or intermittent ductor roller intermittently or periodically contacts the ink fountain roller to remove a strip of ink from the ink fountain roller. The vibrator roller then moves away from the ink fountain roller and moves into contact with the first ink distribution roller to transfer the strip of ink to the first ink distribution roller. The periodic movement of the vibrator roller is timed so that ink is periodically transferred to the first ink distribution roller, to provide an optimum amount of ink to the ink distribution rollers.

As an example, the vibrator roller may transfer additional ink to the first ink distribution roller every 12 revolutions of the plate cylinder. That is, each cycle of the vibrator roller corresponds to 12 revolutions of the plate cylinder and hence 12 sheets of the printed product. To transfer additional ink more or less often will generally provide too much ink or too little ink to the ink distribution rollers, which in turn will affect the quality of the printed product.

Generally, during the cycle of the vibrator roller, the vibrator roller is in contact with the ink distribution roller longer than the ink fountain roller. The required amount of ink can be picked up by the vibrator roller relatively quickly, but more time is required before additional transfer of ink to the distribution rollers is needed. Thus, the drive of the vibrator roller is generally designed to keep the vibrator roller in contact with the ink distribution roller longer than the ink fountain roller.

German Patent No. 39 35 215 A1 discloses a vibrator-type inking unit for a high-speed rotary printing machine, the vibrator-type inking unit permitting an adjustment of the ratio between the driving speed of the cam gear of the vibrator roller and the speed of the plate cylinder. For this purpose the cam gear of the vibrator roller is driven by means of an electromotor, so that it is possible to adjust any cycle of the vibrator roller with respect to a machine rotation. Furthermore, this publication provides an adjustable drive of the ink fountain roller, thus permitting a regulation of the amount of ink conveyed into the inking unit.

Furthermore, the known publication European Patent No. 0 645 242 A1 shows a method of controlling the sheet feeding in a printing machine, the method taking into account the angular position of the drive of the vibrator roller. This angular position may be detected, for example, digitally or by means of sensors in order to feed the following sheet to be printed according to a certain rhythm.

The aforementioned publications, however, do not contain any hint as how to influence the amount of ink available in the inking unit, if a number of successive machine stops and restarts are necessary, for example. In this case, there is the risk of overinking or underinking of the printing plate depending on the position of the vibrator roller and the selected cycle of the vibrator roller. If, for example, only a small amount of ink is required and the cycle of the vibrator roller is 12:1 (i.e. the plate cylinder rotates 12 times, whereas the vibrator roller goes through a cycle only one time), there is the risk of underinking on the twelfth printing sheet given an unfavorable position of the vibrator roller.

OBJECT OF THE INVENTION

Proceeding from these facts it is the object of the present invention to control the cycle of the vibrator roller as a function of the point of time at which it contacts the ink fountain roller in order to achieve a uniform inking after a machine stop.

SUMMARY OF THE INVENTION

According to the invention this object is achieved by the following method steps:

- the command "impression throw-off", "stop printing", or "emergency stop" causes the ink fountain roller to be stopped,
- the distance/phase position reached by the drive of the vibrator roller at this point in time is determined,
- the vibrator roller is engaged at the following distributor roller,
- the drive of the vibrator roller is stopped,
- the command "impression throw-on" or "start printing" causes the ink fountain roller to be driven again, and simultaneously the drive of the vibrator roller with the distance/phase position reached up to the command "impression throw-off", "stop printing", or "emergency stop" is also switched on.

In other words, at times a printing operation is interrupted either through a stopping of the printing press in the middle of a print job, such as in an emergency, or just stopping the printing, which involves stopping the ink impression transfer from the plate cylinder to the blanket cylinder and ultimately to the paper sheet or other printing material. During the printing stop the ink fountain roller is stopped. The phase position of the drive of the vibrator roller is determined; that is, the point in the cycle of the drive of the vibrator roller is determined. The phase position may correspond to a distance the vibrator roller drive has travelled or an angular position of the vibrator roller drive. The vibrator roller is engaged at the first ink distribution roller. The first ink distribution roller is the ink distribution roller that the vibrator roller transfers ink to during printing press operation. The resumption of printing causes the ink fountain roller to be driven again, and at the same time the drive of the vibrator roller is switched on with the drive of the vibrator roller beginning at the same phase position or cycle position as when the printing was stopped.

As discussed in the Background Information, the vibrator roller typically contacts the ink distribution roller longer than the ink fountain roller. Thus, the point in the cycle of the driver of the vibrator roller is determined. Because the timing of the vibrator roller in a given position varies, it is often not adequate to determine only the position of the vibrator roller, but rather the position of the driver of the vibrator roller is important in order to determine the point in the cycle.

This method ensures that, after a machine stop, the same cycle of the vibrator roller which has been set before is continued. For example, if, given a cycle of 12:1, the plate cylinder has already carried out seven rotations, the vibrator-roller cycle causes the vibrator roller to move towards the ink fountain roller at the command "impression throw-on" as soon as the plate cylinder will have effected another five rotations. As a result thereof, the amount of ink available in the inking unit is kept unchanged so that the risk of over-inking or under-inking is excluded even in the case of a number of machine stops.

The method discussed above indicates that the vibrator roller is engaged at the first ink distribution roller upon the interruption of the printing process. In some applications the vibrator roller may be positioned between the ink fountain roller and the ink distribution roller, or the vibrator roller may be engaged with the ink fountain roller. Thus, the vibrator roller can be maintained in a position between the ink fountain roller and the first ink distribution roller or be engaged with the ink fountain roller upon printing interruption. That is, the position of the vibrator roller maintained during printing interruption may correspond to the position the vibrator roller was in upon printing interruption, that is the position of the vibration roller which corresponds to the point in the cycle of the drive of the vibration roller.

In addition, the position in the vibrator-roller cycle at which position the vibrator roller is started in, when the command "start printing" is given, may not be the exact same position as the position of the vibration roller in the vibration-roller cycle when printing was interrupted, but the restart position of the vibration roller in the vibration-roller cycle will be based on the position of the vibration roller in the vibration-roller cycle when printing was interrupted. That is, the position of the vibrator roller in the cycle when printing is restarted may be altered from the cycle position determined when printing was interrupted, but the cycle position of the vibrator roller when printing is restarted will be based on the cycle position of the vibrator roller when printing is interrupted. For example, if printing interruption occurs when the vibrator roller is moving from the ink duct roller to the ink distribution roller, it may be equally appropriate to start the vibrator roller in contact with the ink distribution roller. In addition, if printing is interrupted for a relatively long period of time, it may be appropriate to replenish the ink on the ink distribution roller sooner than during continuous printing, which could be accomplished by restarting the vibrator roller in a position of the cycle where moving the vibrator roller to the ink duct roller occurs sooner. In summary, it is within the scope of the invention to restart the vibrator roller in a cycle position which is not identical to the stop position, if the restart cycle position of the vibrator roller is adjusted based on the cycle position of the vibrator roller when printing was interrupted.

The term "command 'impression throw-off'" or "command 'stop printing'" indicates that printing stops, but many of the rollers and parts of the printing press may continue to rotate and function. The term "command 'emergency stop'" indicates that printing stops and possibly, but not necessarily, the entire printing press stops. The term "command 'impression throw-on'" or "command 'start printing'" indicates that printing resumes, but many of the rollers and parts of the printing press may have been running; that is, the printing press is not necessarily being started up from a complete stop of the printing press.

When the vibrator roller is said to be "engaged" at another roller, this means that the vibrator roller is contacting the other roller and possibly the two rollers are rotating together; although the two contacting rollers may not be rotating but are in stationary contact.

BRIEF DESCRIPTION OF THE DRAWINGS

The invention is described below with reference to the attached drawing.

DESCRIPTION OF THE PREFERRED EMBODIMENT

Figure 1:
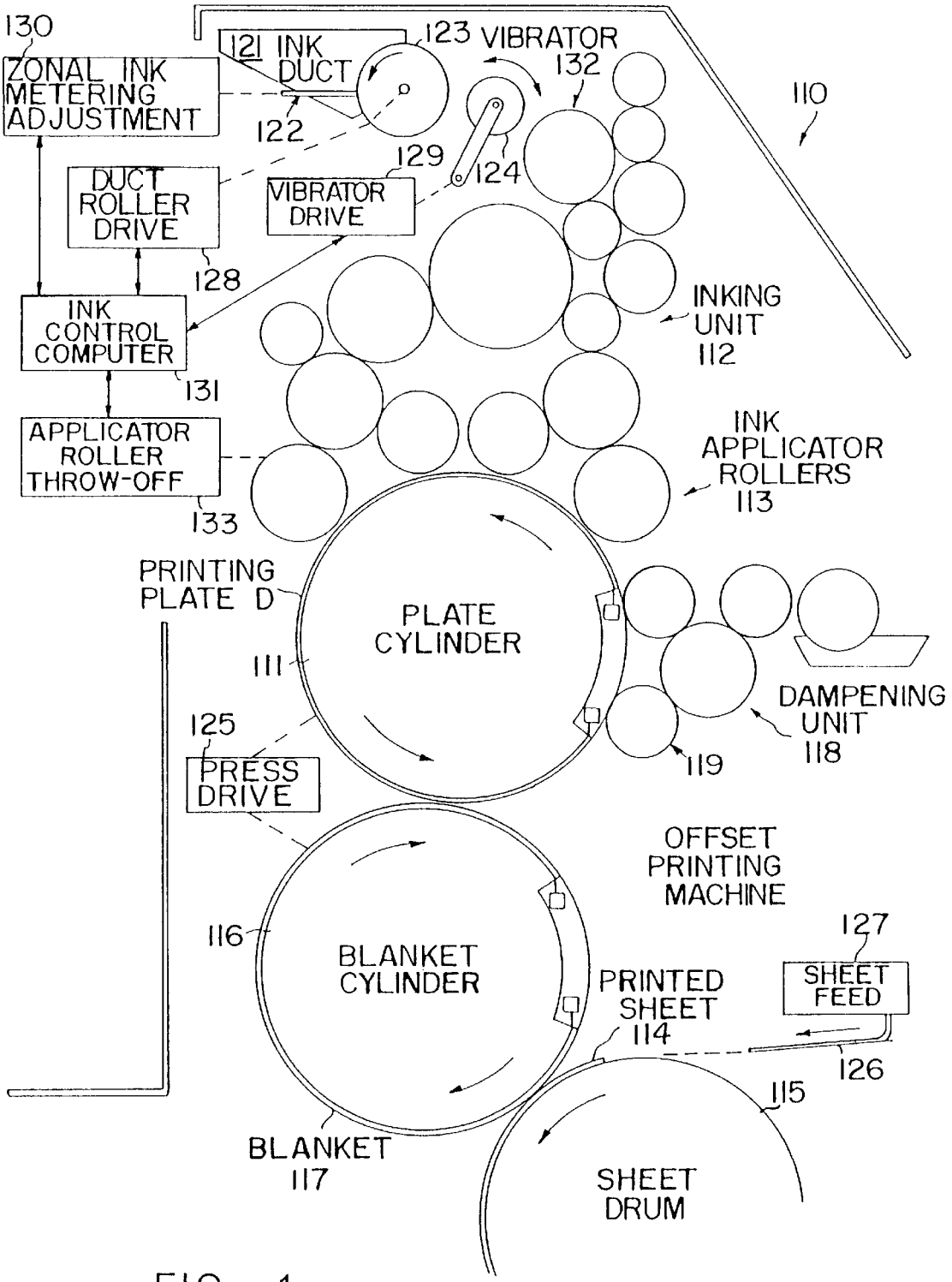
FIG. 1 is a schematic representation of a side view of a printing press which is suitable to use the method of controlling a vibrator roller.

Referring to FIG. 1, a fairly conventional printing press unit 110 generally includes: a plate cylinder 111 for receiving the mounting thereon of a printing plate D; a blanket cylinder 116, which has mounted thereon a blanket 117; a sheet drum 115; an inking unit 112; and a dampening (or wetting) unit 118. Sheets of paper 114 and 126, upon which material is to be printed, are supplied by a sheet feed mechanism 127.

Ink for the printing process is supplied from an ink reservoir or ink duct 121 through an ink duct zonal metering device 122 to an ink fountain roller or ink duct roller 123. A reciprocating vibrator roller 124 transfers zonally adjusted quantities of ink from the ink duct roller 123 to a first ink distribution roller 132 of the inking unit 112. The thus introduced ink travels through the various distribution rollers of the inking unit 112 until it reaches ink applicator rollers 113 which are in contact with the plate cylinder 111 for the transfer of the ink thereto.

Typically, the appropriate dosing of ink for the various inking zones extending transversely across the printing press will be monitored and adjusted by a central control apparatus 131, which will control the zonal ink metering adjustment 130 of the zonal metering device 122, an ink duct roller drive 128 and an drive 129 for the reciprocating vibrator roller 124. Additionally, typically, such a central control device 131 will control applicator roller throw-off circuitry 133 for the separation of the ink applicator rollers 113 from the surface of the printing plate D.

The wetting unit 118 will typically include at least one wetting agent applicator roller 119 for applying the wetting agent to the surface of the printing plate D. Also, the printing press unit 110 will conventionally include a press drive 125 for rotationally driving various of those rollers described above, for example, the plate cylinder 111, the blanket cylinder 116, and various other rollers within the inking unit 112 or wetting unit 118 chains of rollers.

The zonal ink metering device 122 zonally controls the thickness of the ink layer on the ink fountain roller 123. The vibrator roller or intermittent ductor roller 124 intermittently contacts the ink fountain roller 123 to remove a strip of ink from the ink fountain roller 123. The vibrator roller 124 then moves away from the ink fountain roller 123 and moves into contact with the first ink distribution roller 132 to transfer the strip of ink to the first ink distribution roller 132. The periodic movement of the vibrator roller 124 is timed so that ink is periodically transferred to the first ink distribution roller 132, to provide an optimum amount of ink to the ink distribution rollers of the inking unit 112.

The cycle, which the vibrator roller 124 periodically goes through, can be outlined as follows:

1) the vibrator roller 124 comes into contact with the the ink fountain roller 123;
2) the vibrator roller 124 remains in contact with the ink fountain roller 123 to pick up a strip of ink on to the surface of the vibrator roller 124 from the ink fountain roller 123;

3) the vibrator roller 124 moves away from the ink fountain roller 123;

4) as a continuation of the movement away from the ink fountain roller 123, the vibrator roller 124 moves across a space between the ink fountain roller 123 and the first distribution roller 132, so that the vibration roller 124 comes into contact with the first distribution roller 132;

5) the vibrator roller 124 remains in contact with the first ink distribution roller 132 to transfer the ink strips to the first distribution roller 132, from which first distribution roller 132 the ink is transferred among the other ink distribution rollers of the inking unit 112;

6) the vibrator roller 124 moves away from the first ink distribution roller 132; and 7) as a continuation of the movement away from the first ink distribution roller 132, the vibrator roller 124 moves back across the space between the ink fountain roller 123 and the first ink distribution roller 132, so that the vibration roller 124 contacts the ink fountain roller 123 and the cycle begins again.

The vibrator roller drive 129 moves the vibrator roller 124 through the cycle of the vibrator roller 124. The present invention is drawn to a method to control the vibrator roller 124 during interruptions in printing. Specifically, when printing is interrupted the point or phase of the vibrator roller 124 in the vibrator roller cycle is determined. Then when printing resumes, the vibrator roller 124 is restarted at the same point in the vibrator roller cycle as the determined point when the printing was interrupted. Because the amount of time that the vibrator roller 124 is in contact with each of the ink fountain roller 123 and the first distribution roller 132 is controlled, and because the vibrator roller 124 moves back and forth between the ink fountain roller 123 and the first ink distribution roller 132 along substantially the same path, the point of the vibrator roller 124 in the cycle is not only a position of the vibrator roller 124 but how long the vibration roller 124 has been in a position or possibly which direction the vibrator roller 124 is moving. Because the position of the vibrator roller 124 is often not adequate to determine the point, distance, or phase of the vibrator roller 124 in the cycle, generally the vibrator roller drive position allows the determination of the point in the cycle of the vibrator roller 124.

The vibrator roller cycle defines how much ink and how often ink is transferred from the ink fountain roller 123 to the first distribution roller 132 by the vibrator roller 124. For example, if a quantity of ink is to be transferred to the first ink distribution roller 132 for every 12 sheets printed, the number of sheets that have been printed since the last time the quantity of ink was transferred must be determined to determine the point of the vibrator-roller cycle that the vibrator roller 124 is in. If printing is interrupted when 7 sheets have been printed since the last ink quantity transfer, the point in the cycle corresponds to 7 sheets having been printed. Upon resumption of printing, the vibrator roller 124 must resume the cycle at the point in the cycle where 7 sheets have been printed subsequent to the last ink transfer, so that the next ink transfer occurs after 5 more sheets have been printed. Thus, consistent inking of the plate D on the plate cylinder 111 is achieved.

In one embodiment of the invention the vibrator roller 124 is controlled by the following method steps:

1) at the command "impression throw-off" or "emergency stop" printing is interrupted and the ink fountain roller 123 is stopped;

2) the point, distance, or phase position in the cycle reached by the vibrator roller drive 129 at this point in time is determined;

3) the vibrator roller 124 is engaged at the first distributor roller 132;

4) the vibrator roller drive 129 is stopped; and 5) at the command "impression throw-on" printing is resumed, the ink fountain roller 123 is driven again, and simultaneously the vibrator roller drive 129 is switched on at the same point, distance, or phase position determined at the time of the command "impression throw-off" or "emergency stop."

In an alternate embodiment of the invention the vibrator roller 124 is controlled by the following method steps:

1) at the command "impression throw-off" or "emergency stop" printing is interrupted and the point, distance, or phase position in the cycle reached by the vibrator roller drive 129 at this point in time is determined; and 2) at the command "impression throw-on" printing is resumed and simultaneously the vibrator roller drive 129 is started at the same point, distance, or phase position determined at the time of the command "impression throw-off" or "emergency stop."

In an alternate embodiment of the invention the vibrator roller 124 is controlled by the following method steps:

1) at the command "impression throw-off" or "emergency stop" printing is interrupted and the point, distance, or phase position in the cycle reached by the vibrator roller drive 129 at this point in time is determined;

2) the vibrator roller drive 129 is stopped; and 3) at the command "impression throw-on" printing is resumed and simultaneously the vibrator roller drive 129 is switched on at the same point, distance, or phase position determined at the time of the command "impression throw-off" or "emergency stop."

In an alternate embodiment of the invention the vibrator roller 124 is controlled by the following method steps:

1) at the command "impression throw-off" or "emergency stop" printing is interrupted and the ink fountain roller 123 is stopped;

2) the point, distance, or phase position in the cycle reached by the vibrator roller drive 129 at this point in time is determined;

3) the vibrator roller drive 129 is stopped; and 4) at the command "impression throw-on" printing is resumed, the ink fountain roller 123 is driven again, and simultaneously the vibrator roller drive 129 is switched on at the same point, distance, or phase position determined at the time of the command "impression throw-off" or "emergency stop."

In an alternate embodiment of the invention the vibrator roller 124 is controlled by the following method steps:

1) at the command "impression throw-off" or "emergency stop" printing is interrupted and the point, distance, or phase position in the cycle reached by the vibrator roller drive 129 at this point in time is determined;

2) the vibrator roller 124 is engaged at the first distributor roller 132;

3) the vibrator roller drive 129 is stopped; and 4) at the command "impression throw-on" printing is resumed and simultaneously the vibrator roller drive 129 is switched on at the same point, distance, or phase position determined at the time of the command "impression throw-off" or "emergency stop."

In an alternate embodiment of the invention the vibrator roller 124 is controlled by the following method steps:

1) at command "impression throw-off" or "emergency stop" the printing is interrupted and the point or phase position in the cycle reached by the vibrator roller 124 at this point in time is determined; and 2) at the command "impression throw-on" printing is resumed and simultaneously the vibrator roller 124 is switched on at the same point or phase position determined at the time of the command "impression throw-off" or "emergency stop."

In an alternate embodiment of the invention the vibrator roller 124 is controlled by the following method steps:

1) at the command "impression throw-off" or "emergency stop" printing is interrupted and the point or phase position in the cycle reached by the vibrator roller 124 at this point in time is determined;

2) the vibrator roller 124 is engaged at the first distributor roller 132; and 3) at the command "impression throw-on" printing resumes and simultaneously the vibrator roller 124 is switched on at the same point or phase position determined at the time of the command "impression throw-off" or "emergency stop."

In an alternate embodiment of the invention the vibrator roller 124 is controlled by the following method steps:

1) at the command "impression throw-off" or "emergency stop" printing is interrupted, the ink fountain roller 123 is stopped, and the point or phase position in the cycle reached by the vibrator roller 124 at this point in time is determined; and 2) at the command "impression throw-on" printing is resumed, the ink fountain roller 123 is driven again, and simultaneously the vibrator roller 124 is switched on at the same point or phase position determined at the time of the command "impression throw-off" or "emergency stop."

In an alternate embodiment of the invention the vibrator roller 124 is controlled by the following method steps:

1) at the command "impression throw-off" or "emergency stop" printing is interrupted, the ink fountain roller 123 is stopped, and the point or phase position in the cycle reached by the vibrator roller 124 at this point in time is determined;

2) the vibrator roller 124 is engaged at the first distributor roller 132; and 3) at the command "impression throw-on" printing is resumed, the ink fountain roller 123 is driven again, and simultaneously the vibrator roller 124 is switched on at the same point or phase position determined at the time of the command "impression throw-off" or "emergency stop."

As was discussed earlier, it is within the scope of the invention, regarding any of the above-presented embodiments of the invention, for the cycle position of the vibrator roller 124 when printing is resumed, to be adjusted based on the position determined at the time of the command "impression throw-off", "stop printing" or "emergency stop", so that the restart cycle position of the vibrator roller 124 is not identical to the cycle stop position of the vibrator roller 124 but nevertheless is based on the cycle stop position.

One feature of the invention resides broadly in the method of controlling a vibrator roller in a printing machine during machine stops and impression throw-on characterized by the following method steps: the command "impression throw-off" or "emergency stop" causes the ink fountain roller to be stopped, the distance/phase position reached by the drive of the vibrator roller at this point of time is determined, the vibrator roller is engaged at the following distributor roller, the drive of the vibrator roller is stopped, the command "impression throw-on" causes the ink fountain roller to be driven again, and simultaneously the drive of the vibrator roller with the distance/phase position reached up to the command "impression throw-off" or "emergency stop" is also switched on.

U.S. Pat. No. 5,493,970 discloses a known method and apparatus for regulating ink distribution in a printing press.

U.S. Pat. No. 4,242,958 discloses a known ink duct having an ink metering device.

All of the patents, patent applications and publications recited herein, are hereby incorporated by reference as if set forth in their entirety herein.

The corresponding foreign patent publication applications, namely, Federal Republic of Germany Patent Application No. 196 13 360.2, filed on Apr. 3, 1996, having inventor Rudi Junghans, and DE-OS 196 13 360.2 and DE-PS 196 13 360.2 in are hereby incorporated by reference as if set forth in their entirety herein.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A method of controlling a vibrator roller in a printing press during interruption and resumption of printing, the vibrator roller being driven by a driver to move through a cycle between an ink fountain roller and an ink distribution roller to transfer ink from the ink fountain roller to the ink distribution roller, the cycle having a plurality of positions, the cycle comprising at least the phases of: phase i) moving the vibrator roller from the ink distribution roller to the ink fountain roller; phase ii) holding the vibrator roller in contact with the ink fountain roller for a first period of contact to pick up ink onto the vibrator roller; phase iii) moving the vibrator roller from the ink fountain roller to the ink distribution roller; and phase iv) holding the vibrator roller in contact with the ink distribution roller for a second period of contact to transfer ink from the vibrator roller to the ink distribution roller; said method comprising the steps of:

a) stopping the ink fountain roller when the printing is interrupted, said interrupting of printing comprising the stopping of ink impression transfer from a blanket cylinder to a material to be printed upon;

b) determining the position in the cycle of the vibrator roller driver when the printing is interrupted;

c) holding the vibrator roller in contact with the ink distribution roller during said interruption of printing;

d) stopping the vibrator roller driver; and e) substantially simultaneously restarting the driver of the vibrator roller at the determined position of the cycle as determined in step b) and restarting the ink fountain roller when printing is resumed and the material to be printed on is fed to the blanket cylinder.

2. The method of controlling a vibrator roller according to claim 1, wherein said method comprises the steps of:

interrupting the printing upon an operator of said printing press selecting and entering one of the signals:
"stop printing";
"impression throw-off"; and
"emergency stop"; and resuming printing upon one of the signals:
"start printing"; and
"impression throw-on."

3. A method of controlling a vibrator roller in a printing press during interruption and resumption of printing, the vibrator roller being driven by a device to drive the vibrator roller to move through a cycle between an ink fountain roller and an ink distribution roller to transfer ink from the ink fountain roller to the ink distribution roller, the cycle having a plurality of positions, said cycle comprising at least the phases of: phase i) moving the vibrator roller from the ink distribution roller to the ink fountain roller; phase ii) holding the vibrator roller in contact with the ink fountain roller for a first period of contact to pick up ink onto the vibrator roller; phase iii) moving the vibrator roller from the ink fountain roller to the ink distribution roller; and phase iv) holding the vibrator roller in contact with the ink distribution roller for a second period of contact to transfer ink from the vibrator roller to the ink distribution roller; said method comprising the steps of:

a) interrupting printing by stopping ink impression transfer from a blanket cylinder to a material to be printed;

b) interrupting the cycle of movement of the vibrator roller by stopping the device to drive the vibrator roller;

c) determining the position in the cycle of the vibrator roller in the cycle when printing is interrupted;

d) resuming printing by feeding material to be printed to the blanket cylinder; and e) starting the vibrator roller, when printing is resumed, at a position based on the determined position of the cycle as determined in step c).

4. The method of controlling a vibrator roller according to claim 3, wherein:

said step of determining the position in the cycle of the vibrator roller comprises a step of determining the position in the cycle of the device to drive the vibrator roller in the cycle when printing is interrupted.

5. The method of controlling a vibrator roller according to claim 4, wherein:

said step of starting the vibrator roller, when printing is resumed, comprises a step of starting the driving device at a position based on the determined position of the cycle as determined in step e).

6. The method of controlling a vibrator roller according to claim 5, wherein said method comprises the steps of:

stopping the ink fountain roller when printing is interrupted; and resuming driving the ink fountain roller when printing is resumed.

7. The method of controlling a vibrator roller according to claim 6, wherein said method comprises the step of:

holding the vibrator roller in contact with the ink distribution roller during printing interruption.

8. The method of controlling a vibrator roller according to claim 3, wherein:

said step of interrupting the cycle comprises a step of stopping said vibrator roller.

9. The method of controlling a vibrator roller according to claim 8, wherein said method comprises the steps of:

stopping the ink fountain roller when printing is interrupted; and resuming driving the ink fountain roller when printing is resumed.

10. The method of controlling a vibrator roller according to claim 9, wherein said method comprises the step of:

holding the vibrator roller in contact with the ink distribution roller during printing interruption.

11. A method of controlling a vibrator roller in a printing press during interruption and resumption of printing, said method comprising the steps of:

a) moving the vibrator roller by a driver device through a cycle between an ink fountain roller and an ink distribution roller to transfer ink from the ink fountain roller to the ink distribution roller, the cycle having a plurality of phases;

b) said step of moving the vibrator roller by a driver device through a cycle comprising at least the phases of:

phase i) moving the vibrator roller from the ink distribution roller to the ink fountain roller;

phase ii) holding the vibrator roller in contact with the ink fountain roller for a first period of contact to pick up ink onto the vibrator roller;

phase iii) moving the vibrator roller from the ink fountain roller to the ink distribution roller; and phase iv) holding the vibrator roller in contact with the ink distribution roller for a second period of contact to transfer ink from the vibrator roller to the ink distribution roller;

c) interrupting printing by stopping ink impression transfer from a blanket cylinder to a material to be printed upon;

d) interrupting said step of moving the vibrator roller within said vibrator roller cycle;

e) stopping the driver device of the vibrator roller to thus stop the vibrator roller;

f) determining the phase reached by said vibrator roller driver device in said vibrator roller cycle upon said interrupting of the printing;

g) starting the vibrator roller driver device, upon printing being resumed, at the determined phase of said vibrator roller cycle as determined in step f); and h) resuming printing, upon said starting of the vibrator roller driver device, by resuming ink impression transfer to the material to be printed on, by feeding the material to the blanket cylinder.

12. The method of controlling a vibrator roller according to claim 11, wherein said method comprises the steps of:

stopping the ink fountain roller when printing is interrupted; and resuming driving the ink fountain roller when printing is resumed.

13. The method of controlling a vibrator roller according to claim 12, wherein said method comprises the step of:

holding the vibrator roller in contact with the ink distribution roller during printing interruption.

* * * * *